US006606824B1

(12) United States Patent
Hickman et al.

(10) Patent No.: US 6,606,824 B1
(45) Date of Patent: Aug. 19, 2003

(54) WINDOW OPENING MECHANISM

(76) Inventors: James Arthur Albert Hickman, 14A Seaforth Drive, Blackhall, Edinburgh (GB), EH4 2BX; Gordon Graham McLean, 19 Stenhouse Street West, Edinburgh (GB), EH1 3UJ ( * ) Notice: Subject to any disclaimer, the term of this patent is extended or adjusted under 35 U.S.C. 154(b) by 0 days.

(21) Appl. No.: 09/869,860

(22) PCT Filed: Jan. 6, 2000

(86) PCT No.: PCT/GB00/00033

§ 371 (c)(1),
(2), (4) Date: Jul. 6, 2001

(87) PCT Pub. No.: WO00/40830

PCT Pub. Date: Jul. 13, 2000

(30) Foreign Application Priority Data

Jan. 6, 1999 (GB) ..... 9900097

(51) Int. Cl.[7] ..... E05D 15/58; E05D 15/22
(52) U.S. Cl. ..... 49/254; 49/177
(58) Field of Search ..... 49/176, 177, 381, 49/260, 397, 181, 399, 254; 16/268, 229, 247, 248

(56) References Cited

U.S. PATENT DOCUMENTS

| | | | | | |
|---|---|---|---|---|---|
| 1,628,879 | A | * | 5/1927 | Gillman | 49/254 X |
| 1,664,016 | A | | 3/1928 | Ballner | |
| 1,669,320 | A | | 5/1928 | Beyer | |
| 1,999,025 | A | | 4/1935 | Szekeres | |
| 3,791,074 | A | * | 2/1974 | Waffenschmidt | 49/399 |
| 3,845,585 | A | * | 11/1974 | Cecil | 49/139 |
| 4,035,953 | A | * | 7/1977 | Bierlich | 49/192 |
| 4,133,143 | A | * | 1/1979 | Campisano | 49/388 |
| 4,424,646 | A | * | 1/1984 | Adams | 49/141 |
| 4,888,915 | A | * | 12/1989 | Goldenberg | 49/181 |
| 4,937,916 | A | * | 7/1990 | Redman | 16/243 |
| 5,058,321 | A | * | 10/1991 | Harbom et al. | 49/177 |
| 5,168,665 | A | * | 12/1992 | Goldenberg | 49/181 X |
| 5,490,305 | A | * | 2/1996 | Domingo Ribot | 16/229 |
| 5,542,215 | A | * | 8/1996 | Kubo | 49/397 |
| 5,568,703 | A | * | 10/1996 | Frank et al. | 49/153 |
| 6,070,293 | A | * | 6/2000 | Schreiber | 16/229 |
| 6,145,165 | A | * | 11/2000 | Torcato | 16/225 X |
| 6,205,616 | B1 | * | 3/2001 | Hwang | 16/229 |
| 6,286,262 | B1 | * | 9/2001 | Prevot et al. | 49/371 |

FOREIGN PATENT DOCUMENTS

| | | | | |
|---|---|---|---|---|
| GB | 13594 | | 5/1910 | |
| GB | 3894 | | 11/1910 | |
| GB | 2106170 | * | 4/1983 | 49/381 X |

* cited by examiner

*Primary Examiner*—Daniel P. Stodola
*Assistant Examiner*—Hugh B. Thompson
(74) *Attorney, Agent, or Firm*—Venable LLP; Norman N. Kunitz

(57) ABSTRACT

A sash and case window in which the top sash (14) opens inwards by a hinge (12) which, in the preferred embodiment, resembles a parting bead and is located in a section of the parting bead (8) of the case or box lining (13).

8 Claims, 8 Drawing Sheets

WINDOW OPENING MECHANISM

BACKGROUND OF THE INVENTION

The windows installed in buildings are of many various types and constructed with various materials. Until recently the most widely used material in the construction of a window was timber.

The most widely used timber window is a sash and case window which has been used for over a hundred years and has changed little in construction and design in that time. These windows form part of the fabric of many buildings which are termed "listed buildings" or are in conservation areas and are therefore afforded a measure of protection. The basic design of a timber sash and case window consists of an outer timber lining sometimes referred to as a case or box. This case lining contains timber glazed sashes which can slide upwards and downwards in the case lining and are therefore able to provide ventilation and protection against the elements.

The design of a sash and case window has changed slightly over recent years to provide a cleaning facility for windows in upper levels of a building. This was achieved in part by designing a method whereby the lower sash could be swung inwards on hinges for cleaning. However whilst this solved the outside cleaning of the lower sash the upper sash could only be cleaned by cleaning the lower half of the upper sash by lowering it in the case lining as much as possible and physically hanging out and cleaning as much as possible. The top half of the top sash can only be cleaned by standing on steps and hanging over the top sash and cleaning the top half of the top sash, depending on size. Apart from not complying with safety regulations, it is an extremely dangerous act practised by householders many times, who do not use the services of a professional cleaning company and has led to many accidents and fatalities.

The purpose of this invention is to provide a mechanism and method whereby the upper or top sash will swing inwards in a similar fashion to the lower sash to provide an access facility for safe cleaning of the upper sash or for maintenance purposes.

SUMMARY OF THE INVENTION

According to the invention, we provide a sash and case window comprising a case containing a top sash and a bottom sash which operate vertically therein, the top sash being outward of the bottom sash and the bottom sash being rotatable inwardly on first hinge means provided therefor, wherein second hinge means is provided on which the top sash is rotatable inwardly. The top sash can thus be rotated inwardly to allow easy access for cleaning of the glass in the top sash and/or for maintenance.

The top and bottom sashes are preferably separated by at least one parting bead, most conveniently two parting beads, forming part of the case, and said second hinge means is mounted in a said parting bead.

Preferably, the second hinge means comprises at least one hinge, most preferably an upper hinge and a lower hinge, each hinge comprising a catch which is hingedly mounted in the said parting bead of the case, is rotatable from a substantially vertical closed position to a substantially horizontal open position, and carries at a free end thereof a hinge pin for engagement with a complementary anchor fitting provided in the top sash.

Preferably, the or each said hinge of the second hinge means further includes an insert portion located in a gap provided therefor in the parting bead and affixed to the case, and to which the respective catch is hinged. The catch is preferably formed and arranged so that in the closed position of the catch the catch is recessed in the insert portion and has an outer surface flush with an outer surface of the insert portion which is itself preferably formed and arranged to match the profile of the parting bead in which it is mounted.

Preferably, the or each anchor fitting on the top sash comprises a housing recessed in the top sash and a hinged portion which is rotatable from a substantially vertical closed position, in which it is contained in said housing, to a substantially horizontal open position, and which hinged portion has an opening therein formed and arranged for complementary engagement with the hinge pin of the respective catch.

The bottom sash may, if desired, be rotatable inwardly on at least one hinge provided on a baton rod which is itself hinged, preferably by piano hinge means, to the case. This enables the top sash to be rotated inwardly by a larger angle.

BRIEF DESCRIPTION OF THE DRAWINGS

Preferred embodiments of the invention will now be described by way of example only and with reference to the accompanying drawings in which:

FIG. 3(*b*) is a cross-sectional view of the portion of the top sash of FIG. 3(*a*), taken along the line AA' in FIG. 3(*a*);

FIG. 8(*b*) is a plan view of the window of FIG. 8(*a*), showing the bottom sash swung inwards;

DESCRIPTION OF THE PREFERRED EMBODIMENTS

Figure 1:
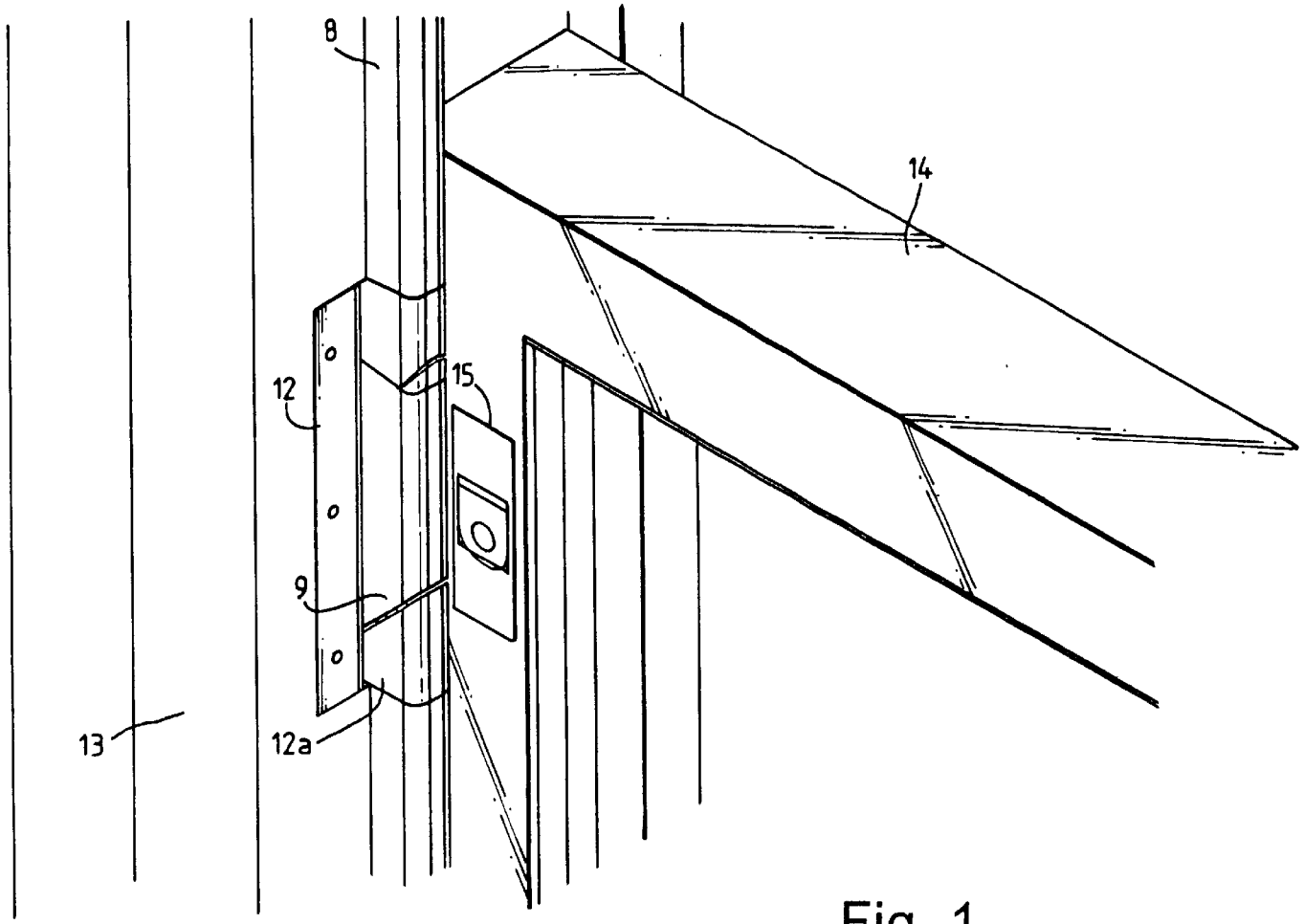
FIG. 1 is a perspective view of a portion of a sash and case window according to the invention.
Figure 2:
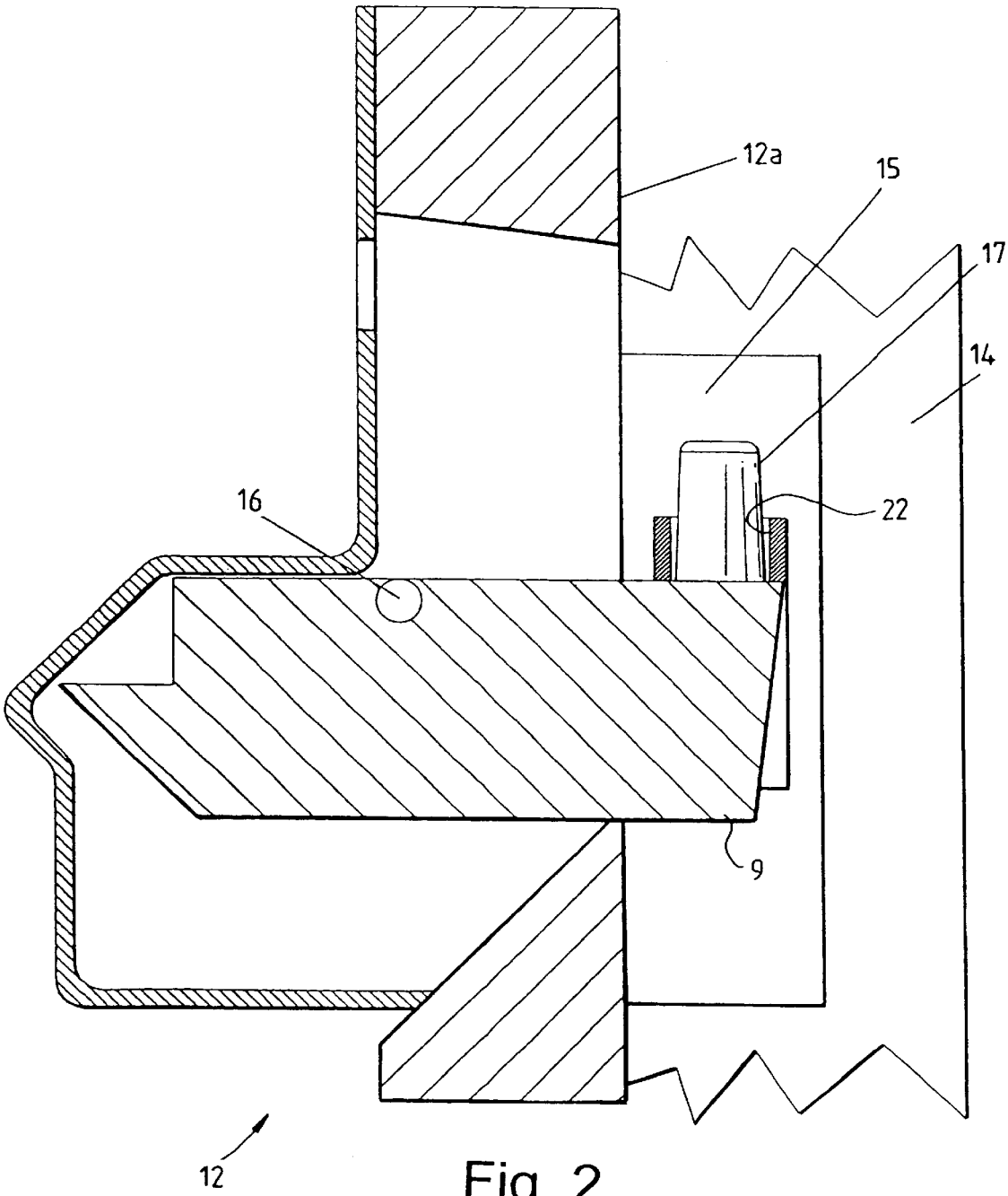
FIG. 2 is a cross-sectional side view through a top sash hinge arrangement incorporated in the window of FIG. 1.
Figure 8A:
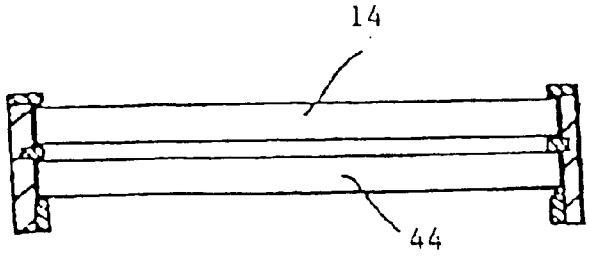
FIG. 8(*a*) is a plan view of the top and bottom sashes in their normal positions in the window case of the window of FIG. 1.
Figure 8B:
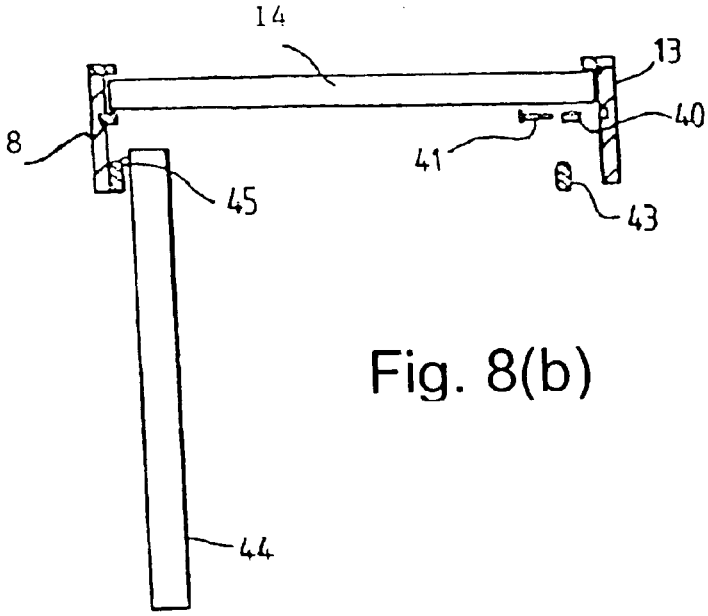

The construction of a sash and case window is well known and consists of an outer or perimeter lining which is hereinafter referred to as the case. The case contains an upper and a lower sash which operate vertically in the case. FIG. 1 shows a portion of a case 13 and a top sash 14 of a sash and case window according to one embodiment of the invention. As shown in FIG. 8, the top sash is located forward (outward) of the bottom sash and the bottom sash can be swung inwards on simplex hinges 45 of known type (usually two simplex hinges) which are mounted to the case 13, thus allowing cleaning of the bottom sash. The upper or top sash 14 is capable of being swung inwards on an axis provided by two further hinges 12 mounted in a parting bead 8 which forms part of the case 13. The parting bead 8 is located in a parting bead groove provided therefor in the main body of the case 13 and it separates the top and bottom sashes (see FIG. 8(*a*)). An opposing or "opening" parting bead 40 is also provided at the opposite side of the case 13. Each further hinge 12 is incorporated in the window 1 by first removing a small section of the parting bead 8. In the gap thus created in the parting bead 8 we then insert a metal shaped construction which provides a parting bead hinge 12 having open and closed positions. The top sash 14 is fitted with another metal formed fitting 15, also having open and closed positions, for forming an anchor point for the top sash 14. The hinge comprises an insert portion 12*a* located in the gap in the parting bead and affixed to the case 13, and a catch 9 which is hinged by a hinge or axis pin 16 to the insert portion 12*a*. In the closed position of the hinge 12, the catch 9 is flush with the outer faces of the insert portion, which itself matches the profile/shape of the parting bead 8. In the open position, the catch 9 protrudes from the insert portion 12*a*. The catch 9 has a pole or pin 17 at the protruding thereof, for engaging with the metal formed fitting 15 in the top sash 14.

Figure 3A:
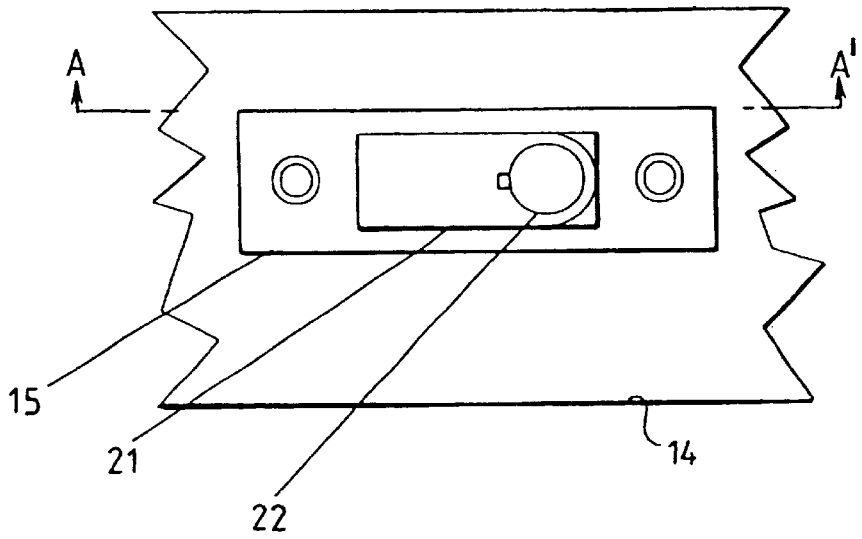
FIG. 3(*a*) is a front view of a portion of the top sash of the window of FIG. 1.
Figure 3B:
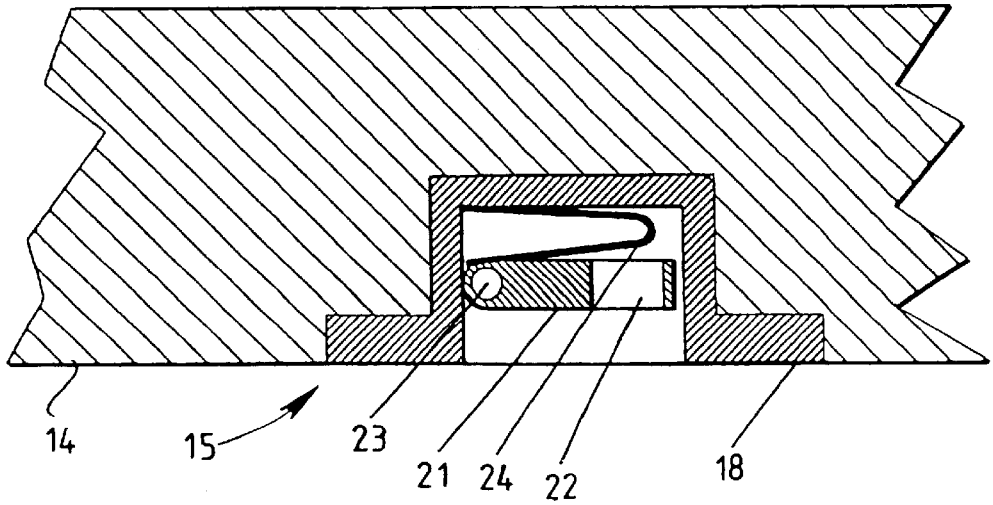

FIG. 3 shows a section through the top sash fitting 15 which comprises a metal perimeter enclosure or housing 18, which contains a hinged metal section 21 with a circular hole or opening 22. The metal section 21 is fitted on an axis or hinge pin 23, and at the rear of metal section 21 is a metal spring 24 which holds metal section 21 in position.

Figure 4:
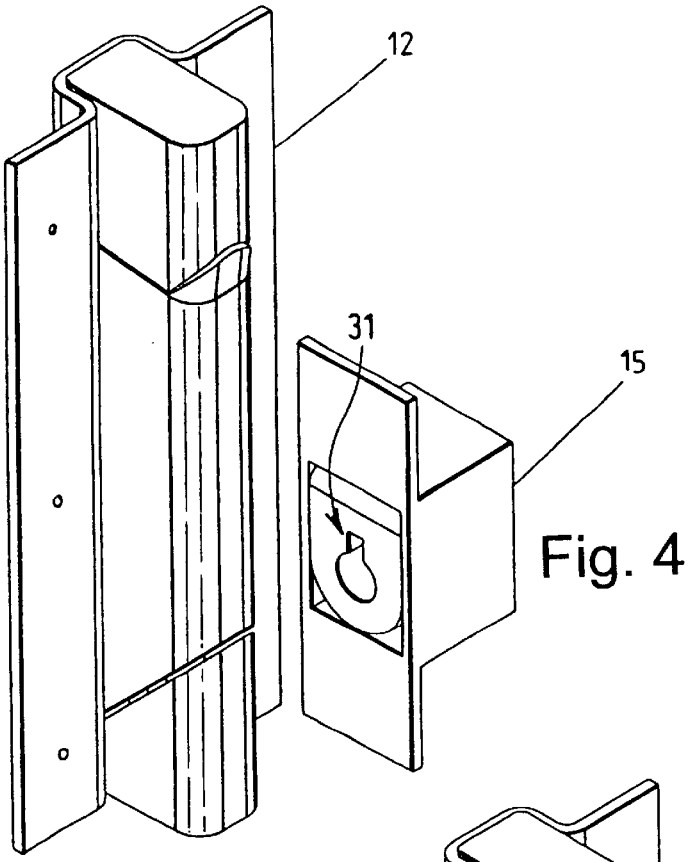
FIG. 4 is a perspective view of two components of the top sash hinge arrangement, prior to being affixed to the window.
Figure 5:
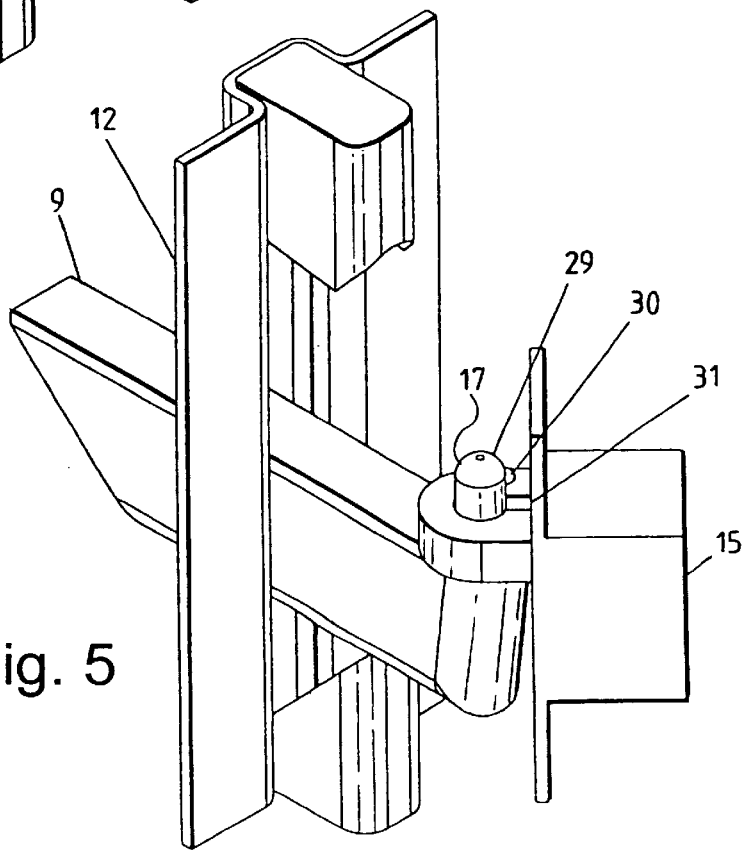
FIG. 5 is a perspective view of the two components of the top sash hinge arrangement, shown in interlocking hinging engagement.

FIG. 4, shows the metal parting bead hinge 12 in its closed position and the top sash hinge fitting 15 in its closed position. FIG. 5 shows the parting bead hinge 12 in the open position with the pin 17 of the catch 9 engaged with the opening 22 in the hinged metal section 21 of the top sash fitting 15. The metal pin or pole 17 includes a small section of metal 30 protruding from the circumference of the pin 17, at the top of the pin 17, which passes through a key way or slot 31 formed in the opening 22 of the top sash fitting 15 in the top sash fitting 15 which itself revolves on the metal pin 18. While the metal protruberence 30 is out of alignment with the key way or slot 31, this prevents the top sash fitting 15 becoming detached or disengaged from the metal pin 17, when in use.

Figure 6:
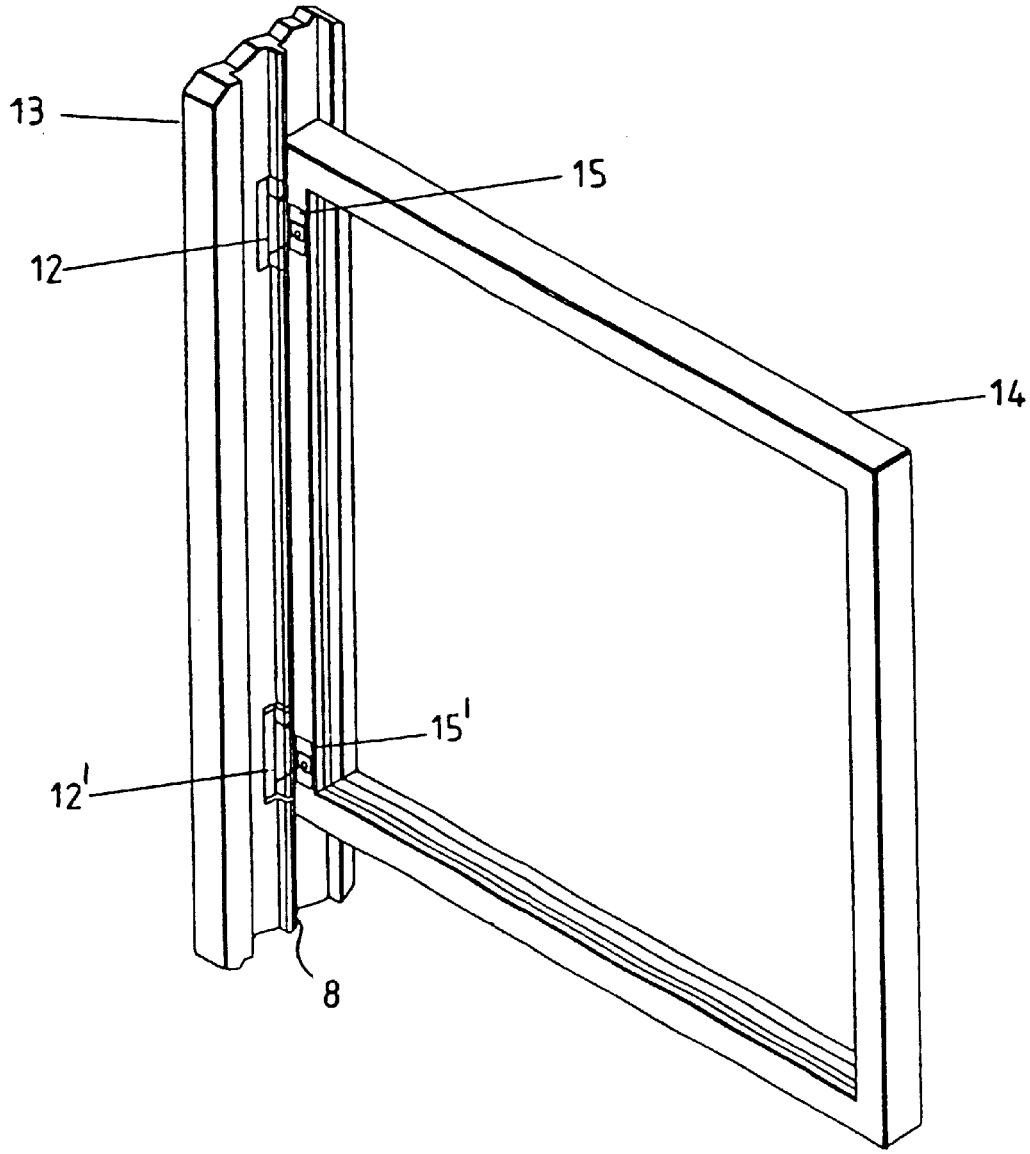
FIG. 6 is a perspective view of the top sash in a portion of the window case.
Figure 7:
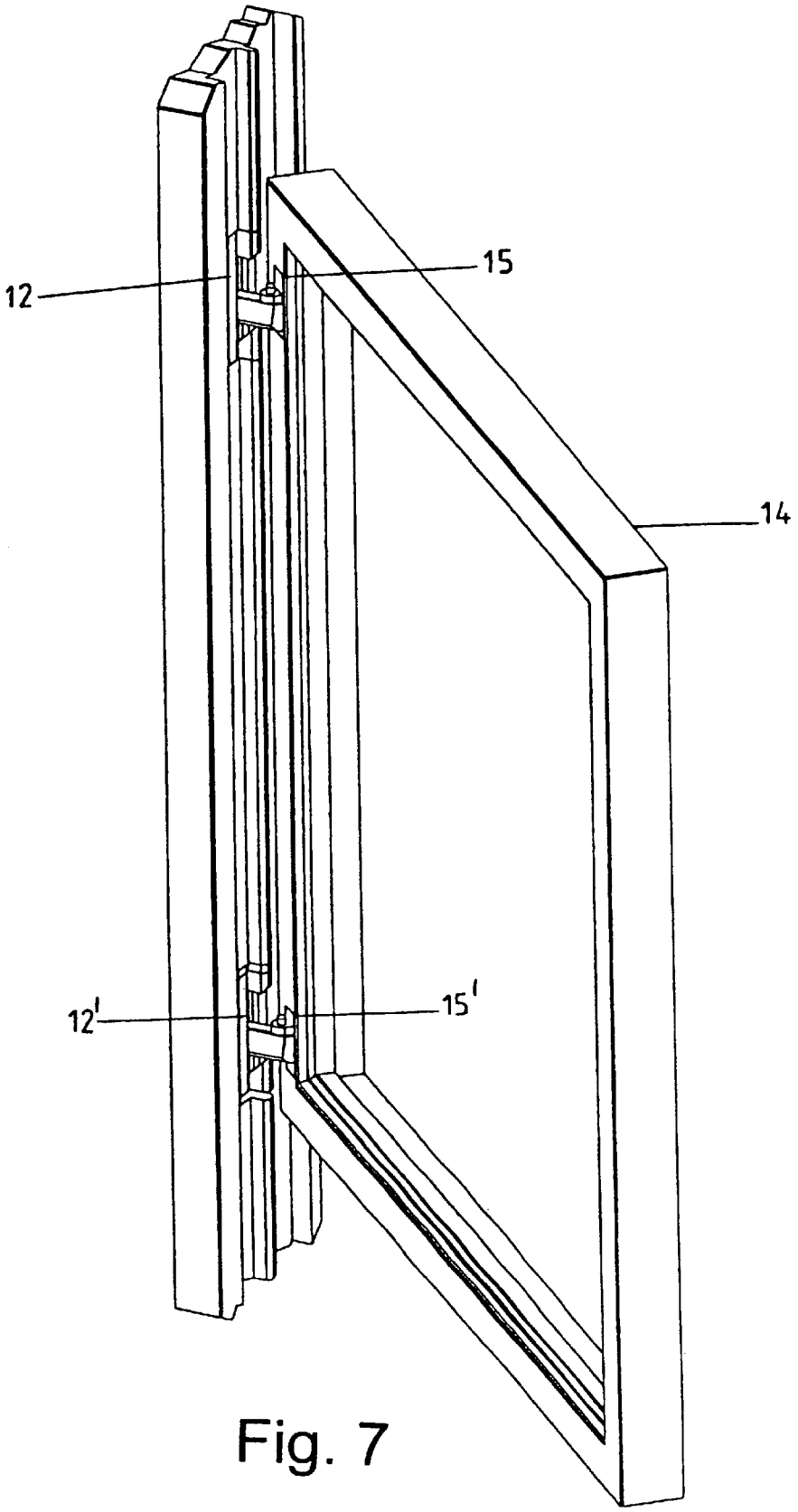
FIG. 7 shows the top sash of FIG. 6, swung inwards on two hinging arrangements like that of FIG. 5.

FIG. 6, shows the top sash 14, in the normal closed position in one side of the case 13, and the parting bead hinge 12, and the top sash fitting 15, in the closed position. As seen from FIG. 6, two parting bead hinges 12,12' and respective metal fittings 15,15' are in fact used, one at an upper portion of the top sash 14 and the other at a lower portion, both mounted in the same parting bead 8 at one side of the case 13. FIG. 7 shows the top sash 14 in the opening inwards position and the parting bead hinge 12 in the case 13 in the open position with the catches 9 thereof engaged with the respective top sash fittings 15,15'.

Figure 9:
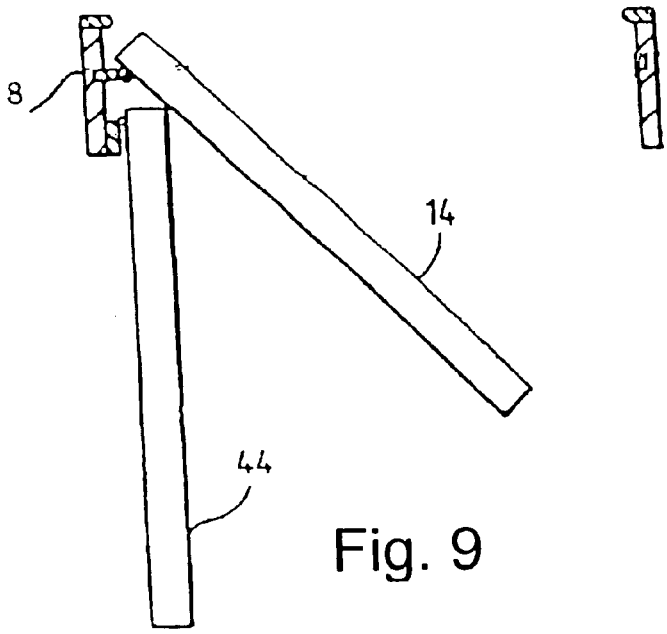
FIG. 9 is a plan view of the window of FIG. 8(*a*), showing both the bottom and top sashes swung inwards.

The engagement operation of the fitting is fairly simple. The catch 9 of the parting bead hinge 12, is manually pulled down to the open position. The top sash fitting 15 is manually opened and the top sash 14, lowered downwards until the pin 17 of the parting bead hinge 12 and the metal section 21 of the top sash hinge fitting 15 are engaged, thereby providing an axis on which the top sash 14 can be swung inwards. To enable the top sash 14 to swing inwards it is also necessary to remove the opening parting bead 40 at the other side of the case 13, and this is achieved by threading a sleeve and bolt 41 through the opening parting bead 40, into the box or case 13, the baton rod 43 at that side of the window already having been removed to allow the bottom sash 44 to swing inwards on the established upper and lower simplex hinges 45 provided therefor in the window. The top sash 14, as shown in FIG. 9, is swung inwards to approximately 45°, or as restricted by the bottom sash 44, to enable access for cleaning or maintenance. It will be obvious to those familiar with sash and case windows that the top sash can be swung inwards at any height in the window by positioning the fittings at any height or level in the window. Whilst the preferred hinge material is metal, the hinges can be formed from any material strong enough to bear the weight of a window sash, such as nylon, plastic, carbon or other composite materials.

It will be appreciated that further modifications to the above-described embodiment are possible without departing from the scope of the invention. For example, instead of using a thread and bolt arrangement to hold the opening parting bead 40 in place, the opening parting bead 40 may be held in place by two ball catches.

Figure 10:
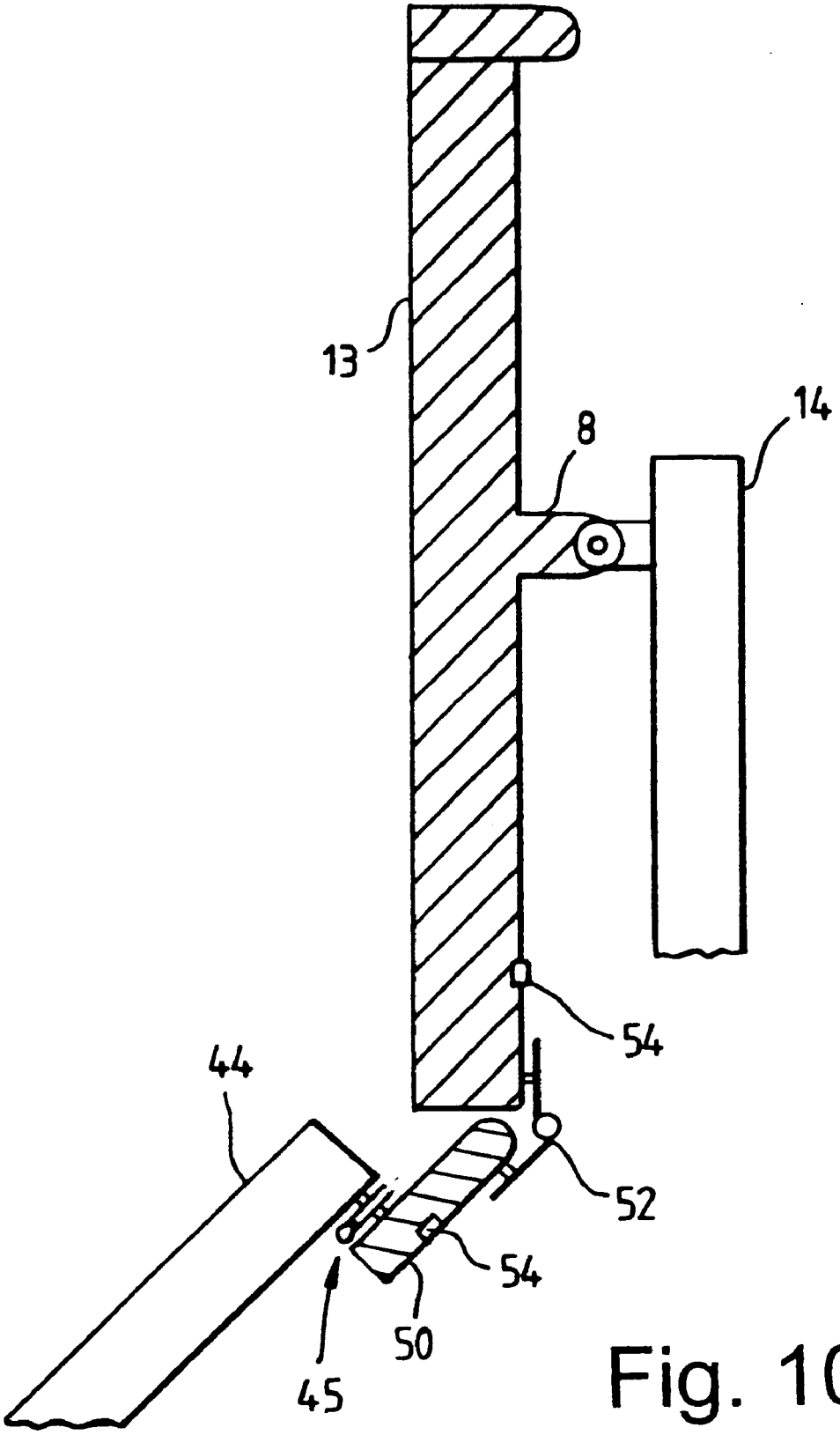
FIG. 10 is a plan view of a modified window incorporating a hinged baton rod for allowing greater inward movement of the bottom and top sashes.

As can be seen from FIG. 9, in the above-described embodiments the amount by which the top sash can be swung inwards is restricted by the presence of the bottom sash. To allow the top sash to open even further, the modified arrangement of FIG. 10 is used. Like parts to those in FIGS. 1–9 are numbered with like reference numerals in FIG. 10. In FIG. 10, the baton rod 50 which carries the simplex hinges 45 (for the bottom sash) is itself hinged to the case 13 by a piano hinge 52 which extends the full height of the bottom sash. Thus, in use, the bottom sash is swung inwards on the simplex hinges 45 and the baton rod 50 is then also swung inwards on the piano hinge 52, this effectively allowing the bottom sash to swing inwards in excess of 45° depending on the position and angle of the internal wall in which the window is fitted. This, in turn, allows the top sash to swing inwards through a similar angle. The baton rod 50 is held in position by one or more magnets 54 when the top and bottom sashes are in their normal positions as shown in FIG. 8(*a*).

What is claimed is:

1. A sash and case window comprising a case containing a top sash and a bottom sash which operate vertically therein, the top sash being outward of the bottom sash and the bottom sash being rotatable inwardly from a normal position thereof on first hinging means provided therefor, second hinging means being provided on which the top sash is rotatable inwardly from a normal position thereof, wherein the top and bottom sashes are separated by at least one parting bead forming part of the case, and said second hinging means is mounted in a said parting bead and comprises at least one hinge comprising a support arm that is mounted in said parting bead of the case, that is moveable from a substantially vertical retracted position to a first substantially horizontal deployed position, and that carries at a free end thereof a hinge pin for engagement with a complementary anchor fitting mounted on the top sash, said anchor fitting having an opening therein formed and arranged for complementary engagement with the hinge pin of a respective support arm, and wherein each said support arm is rotatable between said retracted and deployed positions and each said anchor fitting on the top sash comprises a housing recessed in the top sash and a hinged portion which is rotatable from a substantially vertical retracted position, in which it is contained in said housing, to a second substantially horizontal deployed position for the complementary engagement with said hinge pin of the respective support arm when it is in the second substantially horizontal deployed position.

2. The sash and case window according to claim 1, wherein said of at least one hinge of the second hinging means comprises an upper hinge and a lower hinge, both mounted in said parting bead of the case.

3. The sash and case window according to claim 2, wherein each of said hinges of the second hinging means further includes a housing located in a gap provided therefor in the parting bead and affixed to an outer portion of the case, and to which a respective said support arm is pivotally mounted.

4. The sash and case window as claimed in claim 3, wherein the support arm is formed and arranged so that in the retracted position thereof the support arm is recessed in the housing with an outer surface thereof flush with an outer surface of the parting bead.

5. The sash and case window according to claim 3, wherein said parting bead has a predetermined profile and said second hinging means has a profile formed and arranged to match said profile of said parting bead in which it is located when said second hinging means is in said retracted position.

6. The sash and case window according to claim 1 wherein a baton rod is provided and is hinged to the case, and wherein said first hinging means on which the bottom sash is rotatable inwardly comprises at least one hinge provided on said baton rod.

7. The sash and case window according to claim 6, wherein said baton rod is hinged to the case by a piano hinge.

8. The sash and case window according to claim 7, wherein the baton rod is held in position by at least one magnet when the top and bottom sashes are in their respective normal positions.

* * * * *